US009708940B2

(12) United States Patent
David et al.

(10) Patent No.: US 9,708,940 B2
(45) Date of Patent: Jul. 18, 2017

(54) INTERNAL COMBUSTION ENGINE WITH A CAMSHAFT PHASER

(71) Applicant: DELPHI TECHNOLOGIES, INC., Troy, MI (US)

(72) Inventors: Pascal David, Beidweiler (LU); Pierre Kimus, Attert (BE); Sebastien Mafrica, Aubange (BE)

(73) Assignee: DELPHI TECHNOLOGIES, INC., Troy, MI (US)

( * ) Notice: Subject to any disclaimer, the term of this patent is extended or adjusted under 35 U.S.C. 154(b) by 175 days.

(21) Appl. No.: 14/813,381

(22) Filed: Jul. 30, 2015

(65) Prior Publication Data

US 2016/0032790 A1 Feb. 4, 2016

Related U.S. Application Data

(60) Provisional application No. 62/031,265, filed on Jul. 31, 2014.

(51) Int. Cl.
*F01L 9/04* (2006.01)
*F01L 1/348* (2006.01)
(Continued)

(52) U.S. Cl.
CPC ..... *F01L 1/348* (2013.01); *F01L 1/047* (2013.01); *F01L 9/04* (2013.01); *F02B 77/02* (2013.01);
(Continued)

(58) Field of Classification Search
CPC ..... F01L 1/344; F01L 2001/3443; F01L 2009/043; F01L 2009/0463; F01L 2013/103; F01L 2820/032; F02F 7/0046; F02F 7/006; F02F 2007/0078; F02F 11/002
(Continued)

(56) References Cited

U.S. PATENT DOCUMENTS 7,281,505 B2 * 10/2007 Murase ..... F01L 13/0026 123/90.11
9,016,250 B2 4/2015 David et al.
(Continued)

OTHER PUBLICATIONS

Pascal David et al., Camshaft Phaser, U.S. Appl. No. 14/242,107, filed Apr. 1, 2014.
(Continued)

*Primary Examiner* — Jorge Leon, Jr.
(74) *Attorney, Agent, or Firm* — Joshua M. Haines

(57) ABSTRACT

An internal combustion engine includes a crankshaft rotatable about a crankshaft axis; a camshaft rotatable by the crankshaft about a camshaft axis; an engine cover defining an engine cover volume within the internal combustion engine; a drive member disposed within the engine cover volume which transfers rotational motion from the crankshaft to the camshaft; a camshaft phaser disposed within the engine cover volume which controllably varies the phase relationship between the crankshaft and the camshaft; an actuator which operates the camshaft phaser; and an actuator mount within the engine cover volume which mounts the actuator structurally independent of the engine cover, thereby allowing removal of the engine cover independently of the actuator.

17 Claims, 13 Drawing Sheets

(51) Int. Cl.

| | |
|---|---|
| ***F01L 1/047*** | (2006.01) |
| ***F02B 77/02*** | (2006.01) |
| *F01L 1/344* | (2006.01) |
| *F01L 13/00* | (2006.01) |
| *F02F 7/00* | (2006.01) |
| *F02F 11/00* | (2006.01) |

(52) U.S. Cl.
CPC ..... *F01L 1/344* (2013.01); *F01L 2001/3443* (2013.01); *F01L 2009/043* (2013.01); *F01L 2009/0463* (2013.01); *F01L 2013/103* (2013.01); *F01L 2820/032* (2013.01); *F02F 7/006* (2013.01); *F02F 7/0046* (2013.01); *F02F 11/002* (2013.01); *F02F 2007/0078* (2013.01)

(58) Field of Classification Search
USPC ..... 123/90.11, 90.17, 90.37, 90.38
See application file for complete search history.

(56) References Cited

U.S. PATENT DOCUMENTS

| | | | | |
|---|---|---|---|---|
| 2008/0216783 | A1* | 9/2008 | Ando | F01L 1/022 123/90.17 |
| 2011/0197840 | A1* | 8/2011 | Hoshito | F01L 1/34 123/90.17 |
| 2011/0253085 | A1* | 10/2011 | Kokubo | F01L 1/352 123/90.17 |
| 2012/0291729 | A1 | 11/2012 | David et al. | |
| 2012/0312258 | A1 | 12/2012 | Kimus et al. | |
| 2012/0312262 | A1* | 12/2012 | Hoppe | F01L 1/3442 123/90.17 |
| 2014/0150742 | A1 | 6/2014 | Kinouchi | |

OTHER PUBLICATIONS

Rodrigue Berhin et al., Camshaft Phaser, U.S. Appl. No. 14/307,695, filed Jun. 18, 2014.

* cited by examiner

INTERNAL COMBUSTION ENGINE WITH A CAMSHAFT PHASER

CROSS-REFERENCE TO RELATED PATENT APPLICATIONS

This patent application claims the benefit of U.S. provisional patent application Ser. No. 62/031,265, filed on Jul. 31, 2014, the disclosure of which is hereby incorporated by reference in its entirety.

TECHNICAL FIELD OF INVENTION

The present invention relates to an internal combustion engine with a camshaft phaser for varying the phase relationship between a crankshaft and a camshaft of the internal combustion engine, more particularly to such an internal combustion engine where an actuator is provided for operating the camshaft phaser, and even more particularly to such an internal combustion engine which includes an actuator mount for mounting the actuator structurally independent of an engine cover, thereby allowing the engine cover to be removed independently of the actuator.

BACKGROUND OF INVENTION

A typical vane-type camshaft phaser for changing the phase relationship between a crankshaft and a camshaft of an internal combustion engine generally comprises a plurality of outwardly-extending vanes on a rotor interspersed with a plurality of inwardly-extending lobes on a stator, forming alternating advance and retard chambers between the vanes and lobes. Engine oil is selectively supplied to either the advance chambers or the retard chambers and vented from the other of the advance and retard chambers in order to rotate the rotor within the stator and thereby change the phase relationship between the camshaft and the crankshaft. Some camshaft phasers include a valve spool within the camshaft phaser in order to selectively supply and vent oil to and from the advance and retard chambers as necessary in order to achieve the desired phase relationship between the camshaft and the crankshaft. When the oil is vented from either the advance chambers or the retard chambers, the oil is typically drained out of the camshaft phaser and allowed to reach a drive member, such as a chain, gear, or belt, which transfers rotational motion from the crankshaft to the camshaft phaser. While this may be acceptable to some drive members, particularly chains and gears, other drive members, particularly belts, may not tolerate exposure to oil.

United States Patent Application Publication No. US 2014/0150742 A1 to Kinouchi teaches a camshaft phaser having a first tubular portion extending from a housing of the camshaft phaser and a second tubular portion that extends from a solenoid of the camshaft phaser. The first tubular portion cooperates with the second tubular portion to form an oil accumulating chamber which captures oil that is vented from the camshaft phaser, thereby preventing oil from reaching the drive belt. However, the solenoid actuator is attached to an engine cover which encloses the drive belt. Consequently, in order to remove the engine cover to replace or service the drive belt, the solenoid must be separated from the camshaft phaser, and oil that has accumulated in the oil accumulating chamber is allowed to escape and contaminate the area occupied by the drive belt. As a result, the oil that has escaped must be cleaned up before reassembling the engine cover.

What is needed is a camshaft phaser which minimizes or eliminates one or more the shortcomings as set forth above.

SUMMARY OF THE INVENTION

Briefly described, an internal combustion engine includes a crankshaft rotatable about a crankshaft axis; a camshaft rotatable by the crankshaft about a camshaft axis; an engine cover defining an engine cover volume within the internal combustion engine; a drive member disposed within the engine cover volume which transfers rotational motion from the crankshaft to the camshaft; a camshaft phaser disposed within the engine cover volume which controllably varies the phase relationship between the crankshaft and the camshaft; an actuator which operates the camshaft phaser; and an actuator mount within the engine cover volume which mounts the actuator structurally independent of the engine cover, thereby allowing removal of the engine cover independently of the actuator.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
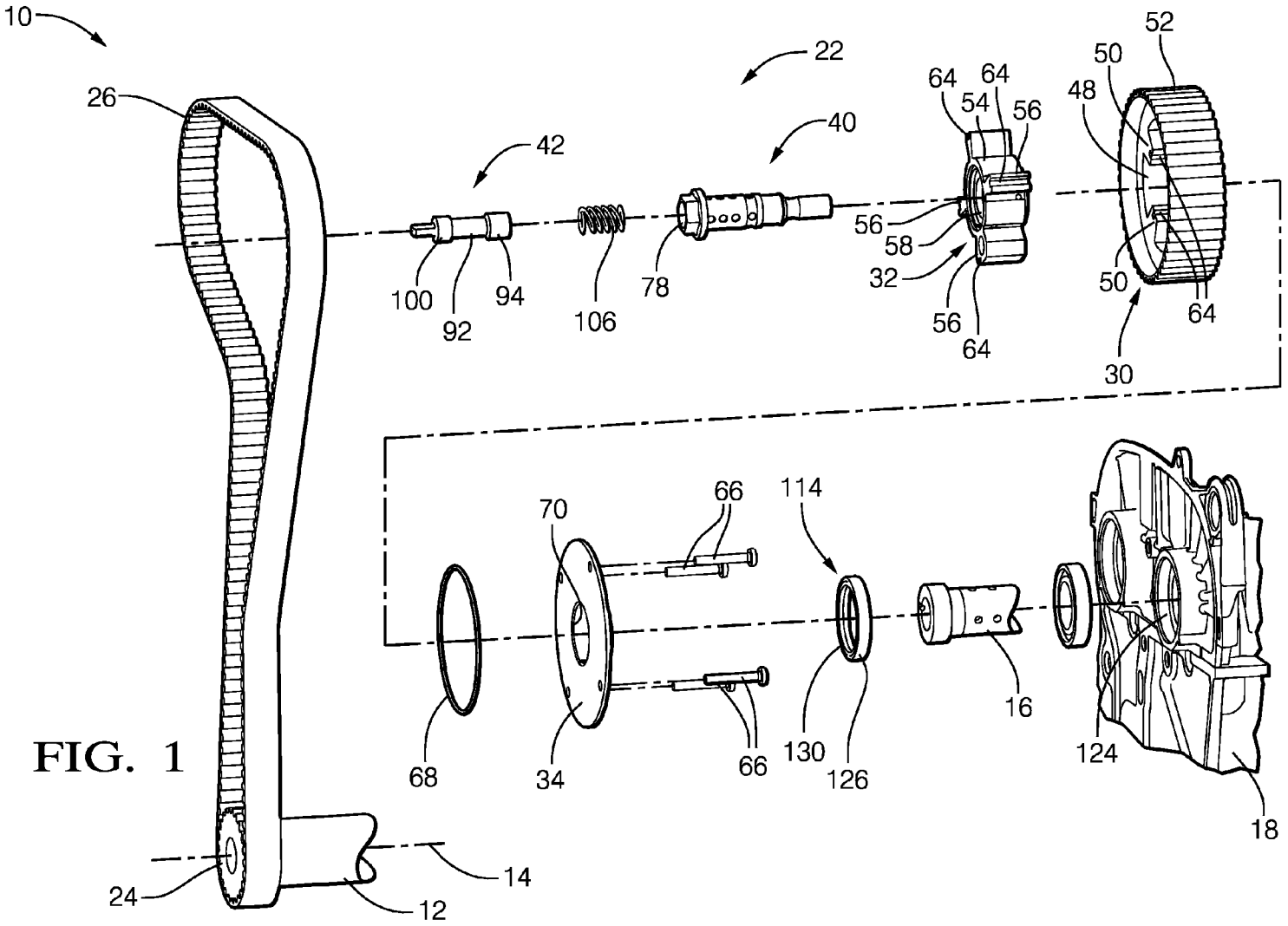
FIG. 1 is an exploded isometric view of an internal combustion engine in accordance with the present invention.
Figure 2:
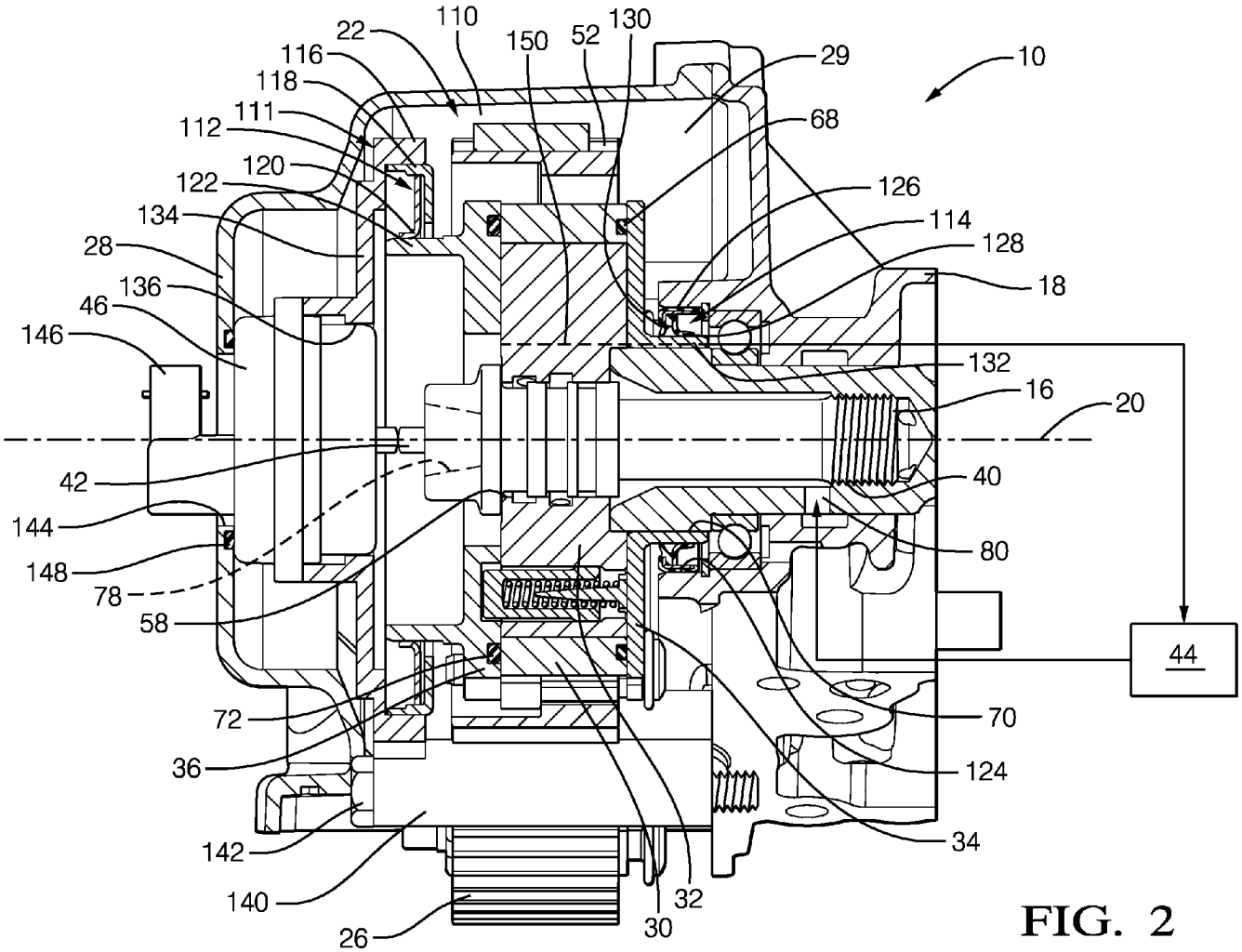
FIG. 2 is an axial cross-sectional view a portion of the internal combustion engine in accordance with the present invention.

Referring to FIGS. 1 and 2, an internal combustion engine 10 is shown in accordance with the present invention.

Internal combustion engine 10 generally includes one or more pistons (not shown), a crankshaft 12 which rotates about a crankshaft axis 14, a camshaft 16 which is supported in a camshaft support 18 and rotates about a camshaft axis 20, and a camshaft phaser 22 which rotates about camshaft axis 20. Internal combustion engine 10 may be, for example only, spark ignited or compression ignited and may be fueled by any liquid fuel or gaseous fuel customarily used, for example only, liquid fuels such as gasoline, diesel fuel, alcohol, ethanol, and the like and blends thereof or gaseous fuels such as natural gas, propane, and the like. The pistons, which are connected to crankshaft 12, reciprocate as a result of combustion of the fuel within the respective combustion chambers (not shown). Reciprocation of the pistons causes crankshaft 12 to rotate about crankshaft axis 14. Crankshaft 12 includes a crankshaft pulley 24 which may be toothed as shown and which rotates a drive member 26, for example, a drive belt which is toothed to mate with crankshaft pulley 24. Camshaft phaser 22 is rotated by drive member 26 and is connected to camshaft 16; consequently, camshaft 16 rotates about camshaft axis 20 as a result of crankshaft 12. Rotation of camshaft 16 about camshaft axis 20 causes one or more combustion valves (not shown) to open and close. The combustion valves allow a charge of air and/or fuel into the combustion chambers and/or exhaust constituents out of the combustion chambers. Camshaft phaser 22 allows the phase of rotation of camshaft 16 relative to crankshaft 12 to be varied, thereby varying the timing of opening and/or closing of the combustion valves relative to crankshaft 12 as will be described in greater detail later. An engine cover 28 (not shown in FIG. 1) encloses drive member 26 and camshaft phaser 22 in an engine cover volume 29 defined in internal combustion engine 10 by engine cover 28.

Figure 3:
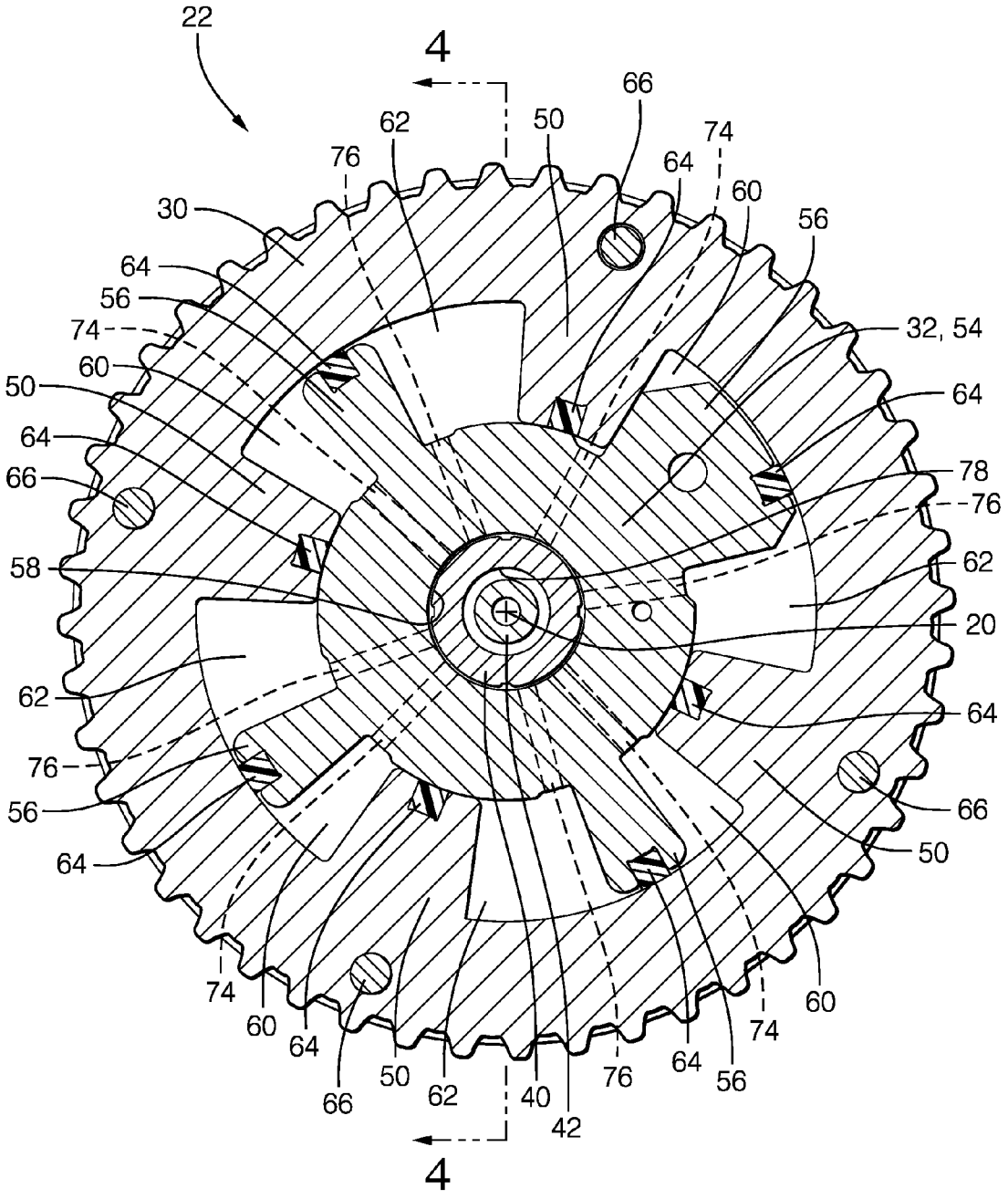
FIG. 3 is a radial cross-sectional view of a camshaft phaser of the internal combustion engine in accordance with the present invention.

With continued reference to FIGS. 1 and 2 and now with additional reference to FIG. 3, camshaft phaser 22 uses pressurized oil to change the phase relationship of camshaft 16 relative to crankshaft 12. As shown, camshaft phaser 22 is what is commonly referred to in the art as a vane-type camshaft phaser. Camshaft phaser 22 generally includes a stator 30 which acts as an input member, a rotor 32 which acts as an output member and which is disposed coaxially within stator 30, a back cover 34 closing off one end of stator 30, a front cover 36 (not shown in FIG. 1) closing off the other end of stator 30, a camshaft phaser attachment bolt 40 for attaching camshaft phaser 22 to camshaft 16, and a valve spool 42 for controlling oil as will be described later which is supplied by an oil supply 44 of internal combustion engine 10. An actuator 46 (not shown in FIG. 1) is provided for positioning valve spool 42 to achieve a desired rotational position of rotor 32 relative to stator 30 as will also be described later. The various elements of camshaft phaser 22 will be described in greater detail in the paragraphs that follow.

Stator 30 is generally cylindrical and includes a plurality of radial chambers 48 (only one radial chamber 48 is labeled in FIG. 1) defined by a plurality of lobes 50 extending radially inward. In the embodiment shown, there are four lobes 50 defining four radial chambers 48, however, it is to be understood that a different number of lobes 50 may be provided to define radial chambers 48 equal in quantity to the number of lobes 50. Stator 30 may also include a camshaft phaser pulley 52 which is toothed as shown and formed integrally therewith or otherwise fixed thereto. Camshaft phaser pulley 52 is configured to be driven by drive member 26. While the drive arrangement between crankshaft 12 and camshaft phaser 22 has been illustrated as using pulleys and a belt, it should now be understood that other drive arrangements may be used, for example only, sprockets and a chain or gears.

Rotor 32 includes a central hub 54 with a plurality of vanes 56 extending radially outward therefrom and a central through bore 58 extending axially therethrough. The number of vanes 56 is equal to the number of radial chambers 48 provided in stator 30. Rotor 32 is coaxially disposed within stator 30 such that each vane 56 divides each radial chamber 48 into advance chambers 60 and retard chambers 62. The radial tips of lobes 50 are mateable with central hub 54 in order to separate radial chambers 48 from each other. Each of the radial tips of lobes 50 and the radial tips of vanes 56 may include one of a plurality of wiper seals 64 to substantially seal adjacent advance chambers 60 and retard chambers 62 from each other.

Back cover 34 is sealingly secured, using cover bolts 66, to the axial end of stator 30 that is proximal to camshaft 16. A back cover seal 68, for example only, an O-ring, may be provided between back cover 34 and stator 30 in order to provide an oil-tight seal between the interface of back cover 34 and stator 30. Tightening of cover bolts 66 prevents relative rotation between back cover 34 and stator 30. Back cover 34 includes a back cover central bore 70 extending coaxially therethrough. The end of camshaft 16 is received coaxially within back cover central bore 70 such that camshaft 16 is allowed to rotate relative to back cover 34. In an alternative arrangement, camshaft phaser pulley 52 may be integrally formed or otherwise attached to back cover 34 rather than to stator 30 as described previously.

Similarly, front cover 36 is sealingly secured, using cover bolts 66, to the axial end of stator 30 that is opposite back cover 34. A front cover seal 72, for example only, an O-ring, may be provided between front cover 36 and stator 30 in order to provide an oil-tight seal between the interface of front cover 36 and stator 30. Cover bolts 66 pass through back cover 34 and stator 30 and threadably engage front cover 36; thereby clamping stator 30 between back cover 34 and front cover 36 to prevent relative rotation between stator 30, back cover 34, and front cover 36. In this way, advance chambers 60 and retard chambers 62 are defined axially between back cover 34 and front cover 36.

Camshaft phaser 22 is attached to camshaft 16 with camshaft phaser attachment bolt 40 which extends coaxially through central through bore 58 of rotor 32 and threadably engages camshaft 16, thereby clamping rotor 32 securely to camshaft 16. In this way, relative rotation between stator 30 and rotor 32 results in a change in phase relationship or timing between crankshaft 12 and camshaft 16.

Figure 4A:
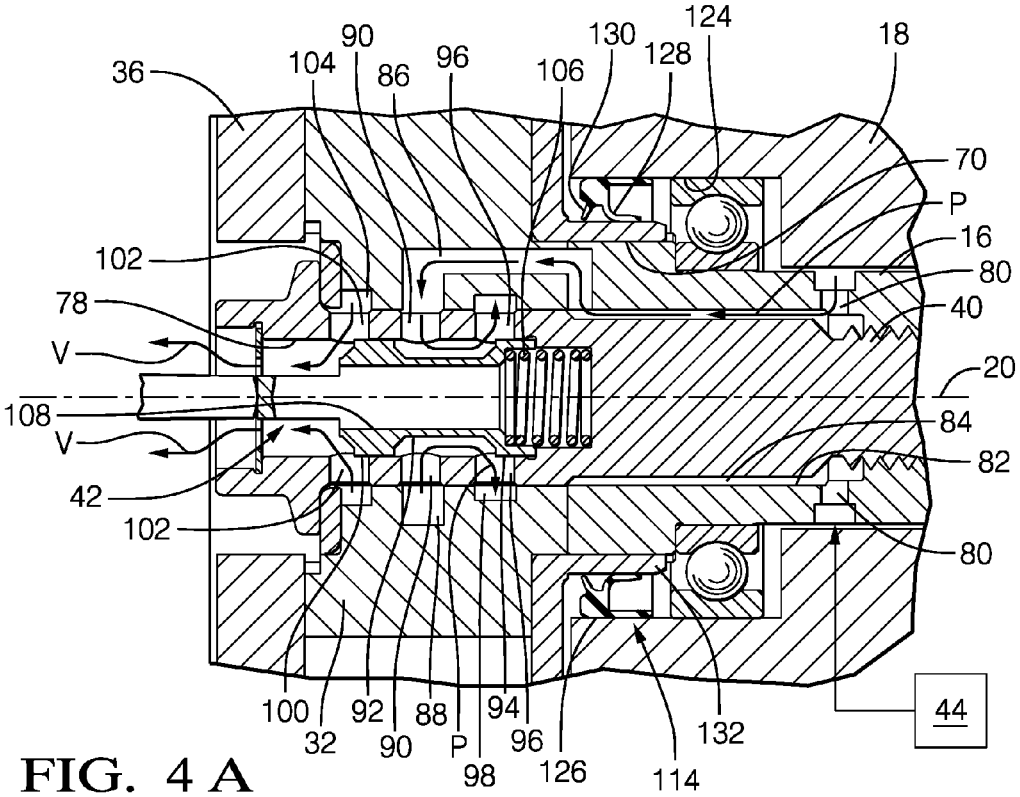
FIG. 4A is an axial cross-sectional view of a portion of the camshaft phaser, taken through section line 4-4 of FIG. 3, showing an actuator in an energized state of operation.
Figure 4B:
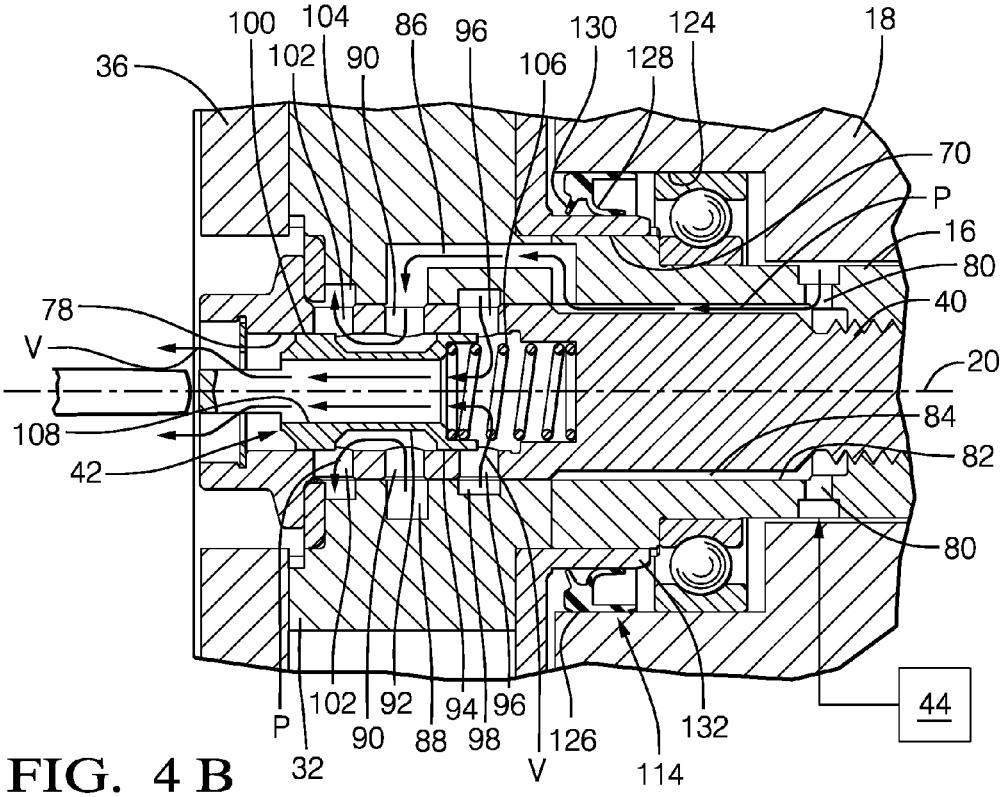
FIG. 4B is an axial cross-sectional view of a portion of the camshaft phaser, taken through section line 4-4 of FIG. 3, showing the actuator in an unenergized state of operation.

With continued reference to FIGS. 1-3 and now with additional reference to FIGS. 4A and 4B, pressurized oil is selectively supplied to advance chambers 60 and vented from retard chambers 62 in order to cause relative rotation between stator 30 and rotor 32 which results in advancing the timing of camshaft 16 relative to crankshaft 12. Conversely, oil is selectively supplied to retard chambers 62 and vented from advance chambers 60 in order to cause relative rotation between stator 30 and rotor 32 which results in retarding the timing of camshaft 16 relative to crankshaft 12. Advance oil passages 74 may be provided in rotor 32 for supplying and venting oil to and from advance chambers 60 while retard oil passages 76 may be provided in rotor 32 for supplying and venting oil to and from retard chambers 62. Supplying and venting of oil to and from advance chambers 60 and retard chambers 62 is controlled by valve spool 42, as will be discussed in the paragraphs that follow, which is coaxially disposed slidably within a valve bore 78 of camshaft phaser attachment bolt 40 such that valve bore 78 is centered about camshaft axis 20.

Oil supply 44 provides a supply of pressurized oil to valve spool 42 through radial camshaft passages 80 which communicate with a camshaft counterbore 82 which forms a camshaft annular oil passage 84 with a portion of camshaft phaser attachment bolt 40. The oil then passes from camshaft annular oil passage 84 to an axial rotor oil passage 86 which extends axially into rotor 32. The oil is subsequently communicated to an annular rotor oil supply groove 88 which extends radially outward from central through bore 58 and intersects axial rotor oil passage 86. Annular rotor oil supply groove 88 is axially aligned with bolt oil supply passages 90 which extend radially through camshaft phaser attachment bolt 40 from valve bore 78. In this way, oil from oil supply 44 is supplied to valve spool 42.

Valve spool 42 includes a body 92 that is generally cylindrical, hollow, and dimensioned to provide annular clearance between body 92 and valve bore 78 of camshaft phaser attachment bolt 40. Valve spool 42 also includes an advance land 94 extending radially outward from body 92 for selectively blocking fluid communication between bolt oil supply passages 90 and advance bolt passages 96 which extend radially outward through camshaft phaser attachment bolt 40 from valve bore 78 and communicate with advance oil passages 74 of rotor 32 through an annular rotor advance oil groove 98 which extends radially outward from central through bore 58. Advance land 94 fits within valve bore 78 of camshaft phaser attachment bolt 40 in a close fitting relationship to substantially prevent oil from passing between advance land 94 and valve bore 78. Valve spool 42 also includes a retard land 100 extending radially outward from body 92 for selectively blocking fluid communication between bolt oil supply passages 90 and retard bolt passages 102 which extend radially outward through camshaft phaser attachment bolt 40 from valve bore 78 and communicate with retard oil passages 76 of rotor 32 through an annular rotor retard oil groove 104 which extends radially outward from central through bore 58. Retard land 100 is spaced axially from advance land 94 and fits within valve bore 78 of camshaft phaser attachment bolt 40 in a close fitting relationship to substantially prevent oil from passing between retard land 100 and valve bore 78.

Valve spool 42 is axially moveable within valve bore 78 with input from actuator 46 and a spool spring 106 which is positioned axially between valve spool 42 and the bottom of valve bore 78. When actuator 46 is in an unenergized state of operation as shown in FIG. 4B, valve spool 42 is positioned in a retard position, by force of spool spring 106, to allow pressurized oil to be supplied to retard chambers 62 as shown by arrows P. At the same time, oil within advance chambers 60 is allowed to be vented through a central passage 108 formed coaxially through valve spool 42 and then out through the end of valve bore 78 as shown by arrows V.

Conversely, when actuator 46 is in an energized state of operation as shown in FIG. 4A, valve spool 42 is positioned in an advance position, by force from actuator 46 overcoming force of spool spring 106, to allow pressurized oil to be supplied to advance chambers 60 as shown by arrows P. At the same time, oil within retard chambers 62 is allowed to be vented through the end of valve bore 78 as shown by arrows V.

Drive member 26 may not be compatible with the oil supplied to camshaft phaser 22; consequently, a dry zone 110 may be formed within engine cover volume 29. Drive member 26 is located within dry zone 110 which is substantially free of the oil supplied to camshaft phaser 22. Actuator 46, which may be a solenoid actuator, is mounted to internal combustion engine 10 via an actuator mount 111 which is at least partially within engine cover volume 29 and dry zone 110 as actuator mount 111 will be described in greater detail later. Dry zone 110 is formed by a sealing arrangement which may comprise an actuator to camshaft phaser seal 112 and an engine to camshaft phaser seal 114. The sealing arrangement will be described in greater detail in the paragraphs that follow.

Referring again to FIGS. 1 and 2, actuator to camshaft phaser seal 112 provides a seal between actuator mount 111 and front cover 36. Actuator mount 111 includes an actuator mount seal support 116 which is ring-shaped and substantially centered about camshaft axis 20. Actuator mount seal support 116 extends axially away from actuator mount 111 toward camshaft phaser 22. Actuator to camshaft phaser seal 112 includes an actuator to camshaft phaser seal supporting body 118 which is ring shaped and secured coaxially within actuator mount seal support 116, for example, by a press fit. Alternatively, actuator to camshaft phaser seal supporting body 118 may be secured to actuator mount seal support 116 by surrounding actuator mount seal support 116, i.e. the radial relationship between actuator to camshaft phaser seal supporting body 118 and actuator mount seal support 116 may be reversed from the relationship shown in the figures. Actuator to camshaft phaser seal supporting body 118 may be made of a rigid material, for example, metal or plastic. Actuator to camshaft phaser seal 112 also includes an actuator to camshaft phaser seal lip seal 120 which extends radially inward from actuator to camshaft phaser seal supporting body 118. Actuator to camshaft phaser seal lip seal 120 may be molded and bonded to actuator to camshaft phaser seal supporting body 118 and may be made of an elastomeric or rubber-like material, for example only, Nitrile Butadiene Rubber (NBR), Viton®, or silicone. Front cover 36 includes a front cover sealing body 122 for radially mating with actuator to camshaft phaser seal lip seal 120. Front cover sealing body 122 may include a sleeve (not show) in a radially surrounding relationship which provides the necessary harness and surface finish to withstand rubbing with respect to actuator to camshaft phaser seal lip seal 120, however, the sleeve may be omitted as shown if front cover sealing body 122 is made from a material of adequate hardness and surface finish. Front cover sealing body 122 is ring-shaped and extends axially away from front cover 36 toward engine cover 28 in a coaxial relationship with actuator mount seal support 116. Front cover sealing body 122 is sized to elastically deform actuator to camshaft phaser seal lip seal 120 when assembled in order to provide an oil-tight seal between front cover sealing body 122 and actuator to camshaft phaser seal lip seal 120. Actuator to camshaft phaser seal lip seal 120 is sized to provide sufficient compliance to accommodate mismatch in concentricity between actuator to camshaft phaser seal 112 and front cover sealing body 122 due to manufacturing tolerances. In this way, oil that is vented from advance chambers 60 and retard chambers 62 through the end of valve bore 78 is prevented from entering dry zone 110 as camshaft phaser 22 rotates with respect to actuator to camshaft phaser seal 112 in operation. In addition to actuator to camshaft phaser seal lip seal 120, actuator to camshaft phaser seal 112 may include a dust seal lip which protects actuator to camshaft phaser seal lip seal 120 from external contamination that may have undesirable effects on actuator to camshaft phaser seal lip seal 120.

Engine to camshaft phaser seal 114 provides a seal between camshaft support 18 and back cover 34. A camshaft support bore 124, which is cylindrical, extends into camshaft support 18 in a coaxial relationship with camshaft 16. Engine to camshaft phaser seal 114 includes an engine to camshaft phaser seal supporting body 126 which is ring shaped and secured coaxially within camshaft support bore 124, for example, by a press fit. Engine to camshaft phaser seal supporting body 126 may be made of a rigid material, for example, metal or plastic. Engine to camshaft phaser seal 114 also includes an engine to camshaft phaser seal lip seal 128 which extends radially inward from engine to camshaft phaser seal supporting body 126. Engine to camshaft phaser seal lip seal 128 may be molded and bonded to engine to camshaft phaser seal supporting body 126 and may be made of an elastomeric or rubber-like material, for example only, Nitrile Butadiene Rubber (NBR), Viton®, or silicone. Engine to camshaft phaser seal 114 may also include an engine to camshaft phaser seal dust lip seal 130 which extends radially inward from engine to camshaft phaser seal supporting body 126 and may be made from the same material as engine to camshaft phaser seal lip seal 128. Engine to camshaft phaser seal dust lip seal 130 protects engine to camshaft phaser seal lip seal 128 from external contamination that may have undesirable effects on engine to camshaft phaser seal lip seal 128. Back cover 34 includes a back cover sealing body 132 for radially mating with engine to camshaft phaser seal lip seal 128. Back cover sealing body 132 is ring-shaped and extends axially away from back cover 34 into camshaft support bore 124 in a coaxial relationship with camshaft support bore 124. Back cover sealing body 132 is sized to elastically deform engine to camshaft phaser seal lip seal 128 when assembled in order to provide an oil-tight seal between back cover sealing body 132 and engine to camshaft phaser seal lip seal 128.

Figure 5:
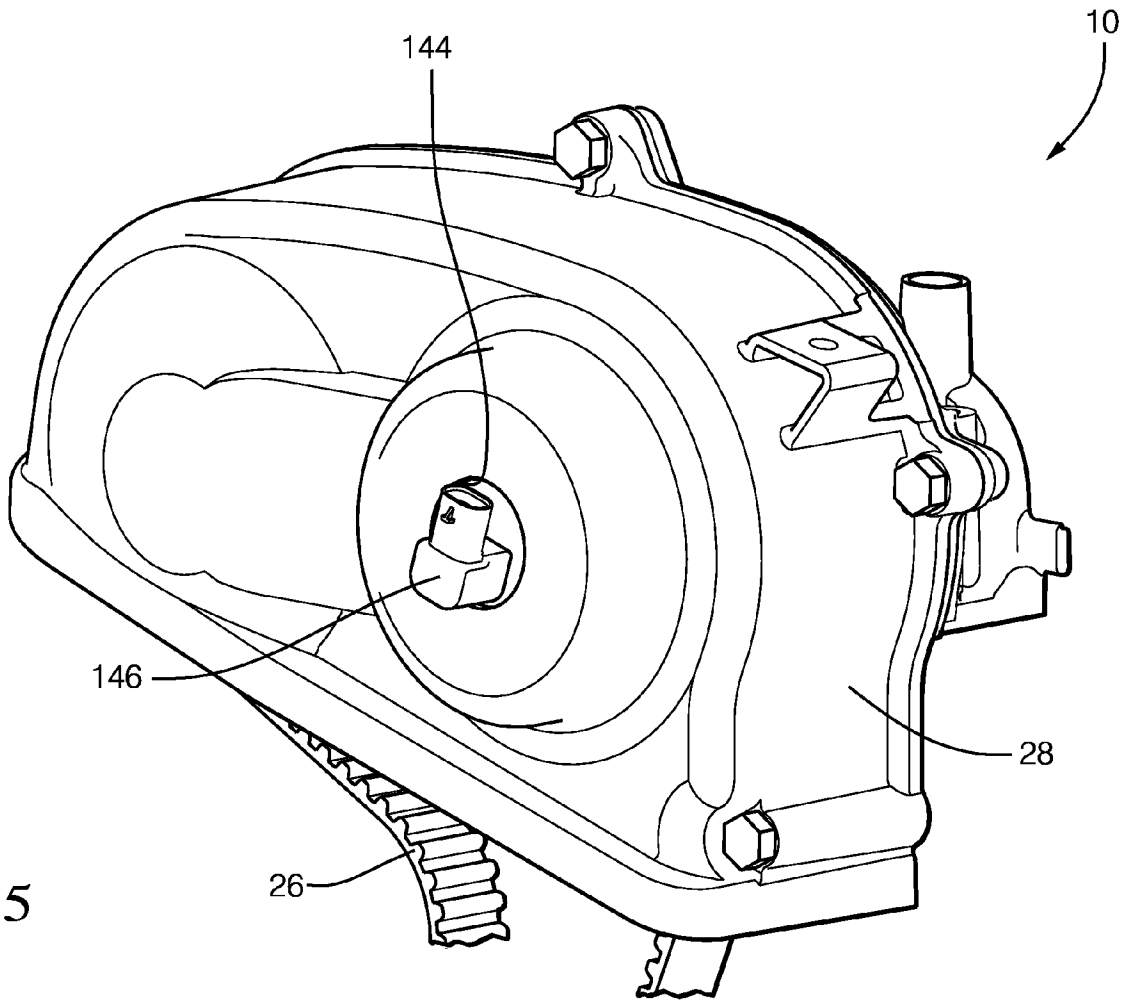
FIG. 5 is an isometric view of the internal combustion engine in accordance with the present invention with an engine cover installed.
Figure 6:
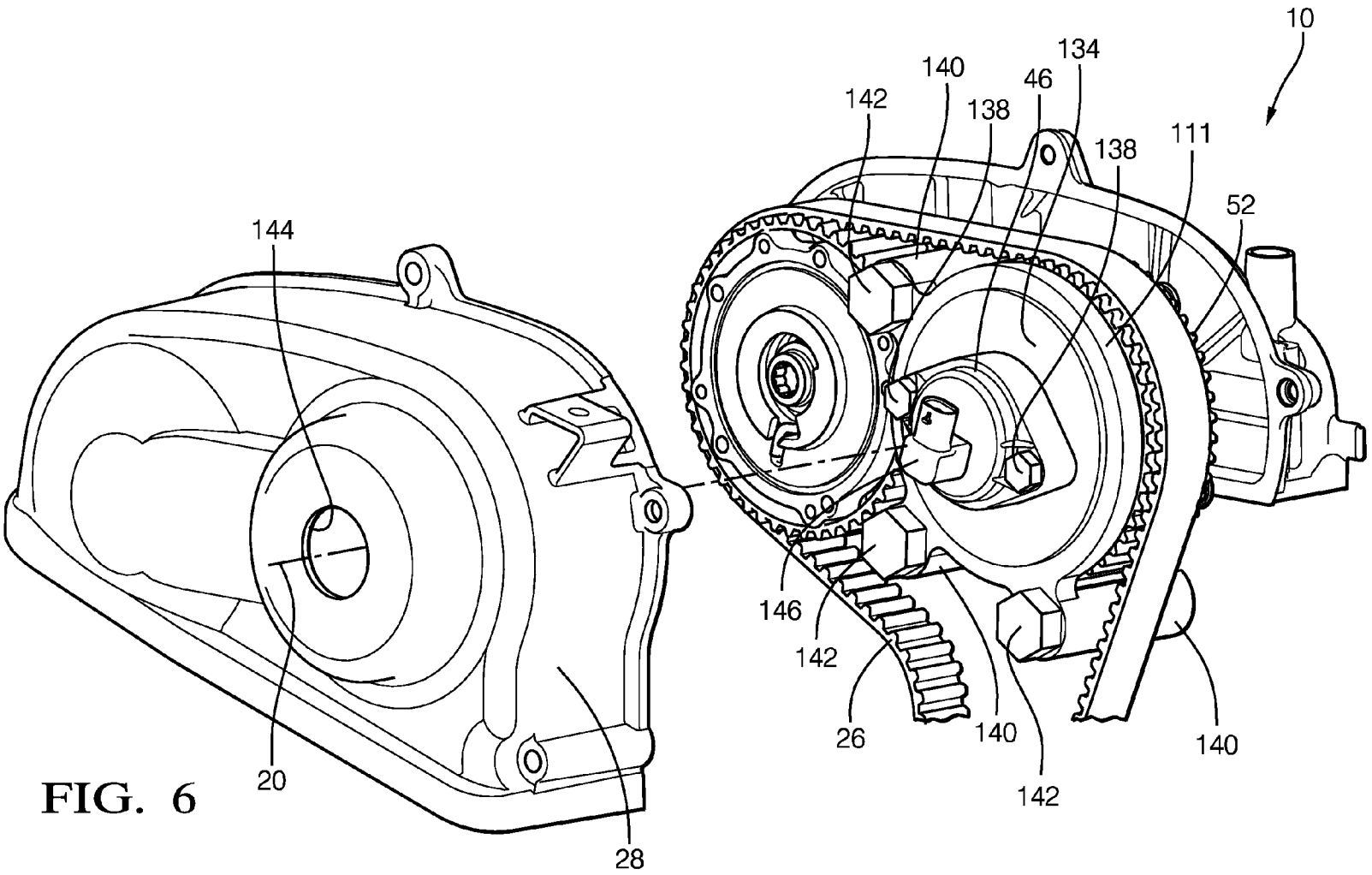
FIG. 6 is the isometric view of FIG. 5 now shown with the engine cover separated.

With continued reference to FIGS. 1 and 2 and now with additional reference to FIGS. 5 and 6, actuator mount 111 includes an actuator mount body 134 with an actuator mount aperture 136 extending axially therethrough such that actuator mount aperture 136 allows a portion of actuator 46 to extend therethrough. Actuator mount seal support 116, which was described above, is defined by actuator mount body 134. Actuator 46 is fixed to actuator mount 111, for example, with actuator bolts 138 which threadably engage actuator mount 111. Actuator 46 is sealed to actuator mount 111, for example by an O-ring, gasket, or sealant (not show), thereby preventing oil from reaching dry zone 110 through actuator mount aperture 136. Actuator mount 111 includes actuator mount mounting bosses 140 to receive actuator mount bolts 142 which threadably engage internal combustion engine 10, thereby clamping actuator mount 111 to internal combustion engine 10.

Engine cover 28 includes an engine cover aperture 144 extending therethrough which allows an electrical connector 146 of actuator 46 to be accessible outside of engine cover volume 29 and dry zone 110, thereby allowing a mating connector (not shown) to be attached to electrical connector 146 in order to control actuator 46. As shown, engine cover aperture 144 may extend through engine cover 28 in a direction substantially parallel to camshaft axis 20. An engine cover to actuator seal 148 may be provided between engine cover 28 and actuator 46 in order to prevent foreign material from the environment from entering dry zone 110 through engine cover aperture 144. Alternatively, actuator seal 148 may be provided between engine cover 28 and actuator mount 111 in order to prevent foreign material from the environment from entering dry zone 110 through engine cover aperture 144. Also alternatively, actuator seal 148 may be a radial seal rather than an axial seal as shown.

A rotor drain passage 150 is provided axially through central hub 54 of rotor 32 in order to return oil to oil supply 44 that is vented from advance chambers 60 and retard chambers 62 through the end of valve bore 78. The oil exits the rotor drain passage 150 that is proximal to camshaft 16 and is prevented from entering dry zone 110 by engine to camshaft phaser seal 114 and is subsequently returned to oil supply 44.

Since actuator 46 is mounted to internal combustion engine 10 structurally independent of engine cover 28, engine cover 28 can be removed from internal combustion engine 10 in order to service drive member 26 without the need to remove actuator 46 from internal combustion engine 10. In order to remove engine cover 28, engine cover 28 is moved in a direction parallel to camshaft axis 20 until electrical connector 146 no longer passes through engine cover aperture 144. Since actuator 46 does not need to be removed, there is no risk of contaminating dry zone 110 with oil from camshaft phaser 22 when servicing drive member 26. It should be noted that actuator mount 111 is within the path of drive member 26, i.e. each actuator mount mounting boss 140 is located within the inner periphery of drive member 26, and consequently, drive member 26 can be removed while actuator 46 and actuator mount 111 are attached to internal combustion engine 10.

Figure 7:
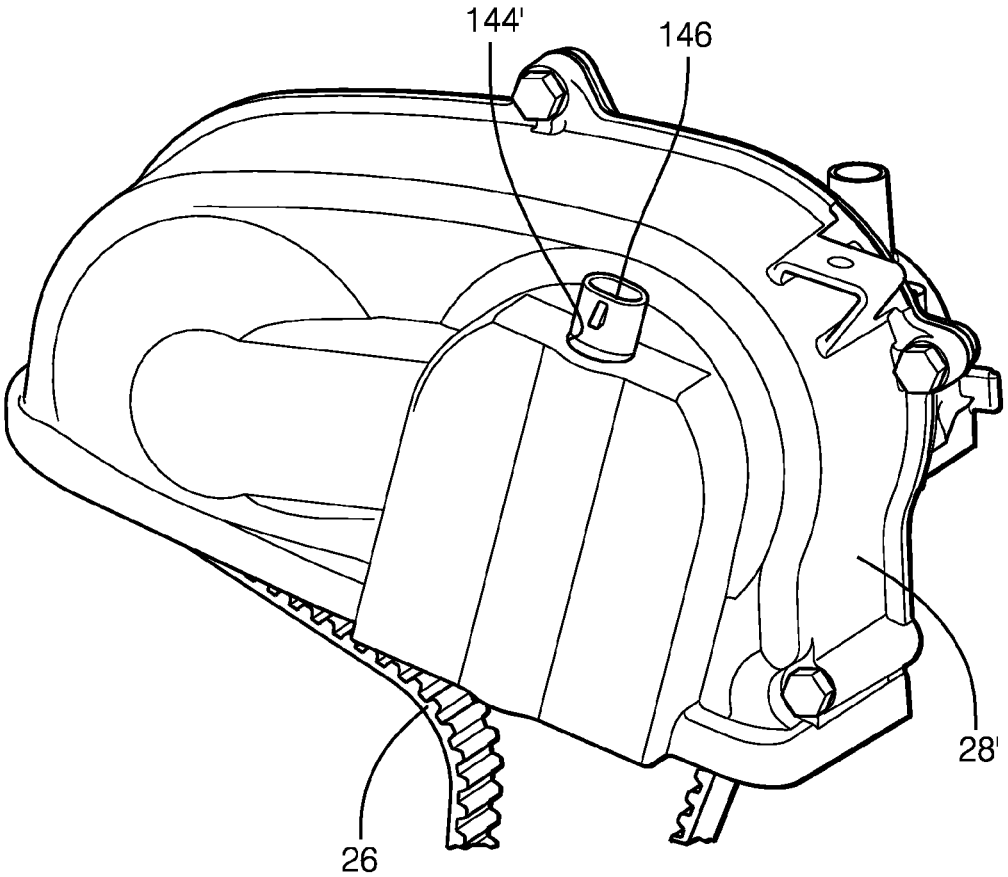
FIG. 7 is an isometric view of the internal combustion engine in accordance with the present invention showing an alternative engine cover installed.
Figure 8:
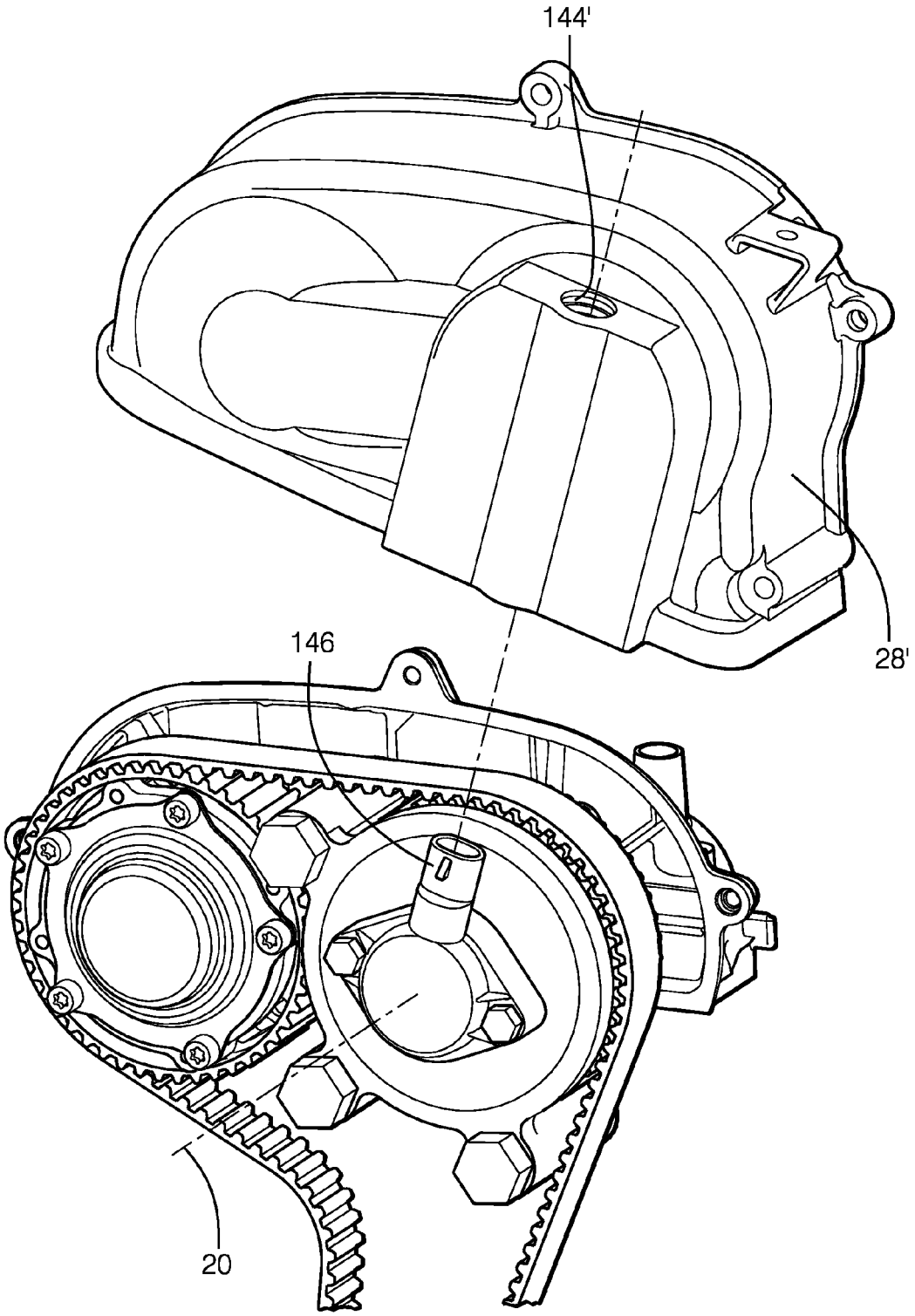
FIG. 8 is the isometric view of FIG. 7 now shown with the engine cover separated.

In an alternative arrangement as shown in FIGS. 7 and 8, an engine cover 28' is provided. Engine cover 28' differs from engine cover 28 in that engine cover 28' includes an engine cover aperture 144' which extends through engine cover 28' in a direction that is substantially perpendicular to camshaft axis 20. In this way, engine cover 28' can be removed from internal combustion engine 10 in direction that is substantially perpendicular to camshaft axis 20. This may be particularly useful when internal combustion engine 10 is in an environment which does not allow engine cover 28' to be displaced parallel to camshaft axis 20 a sufficient amount to facilitate remove of engine cover 28'.

Figure 9:
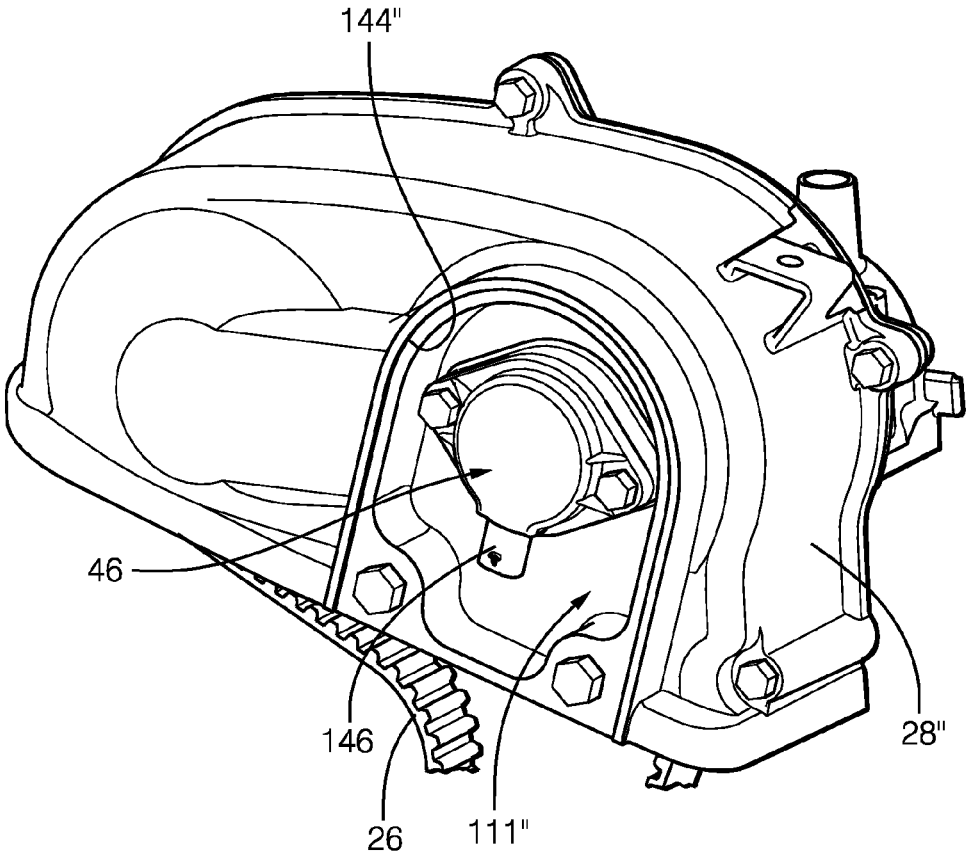
FIG. 9 is an isometric view of the internal combustion engine in accordance with the present invention showing another alternative engine cover installed.
Figure 10:
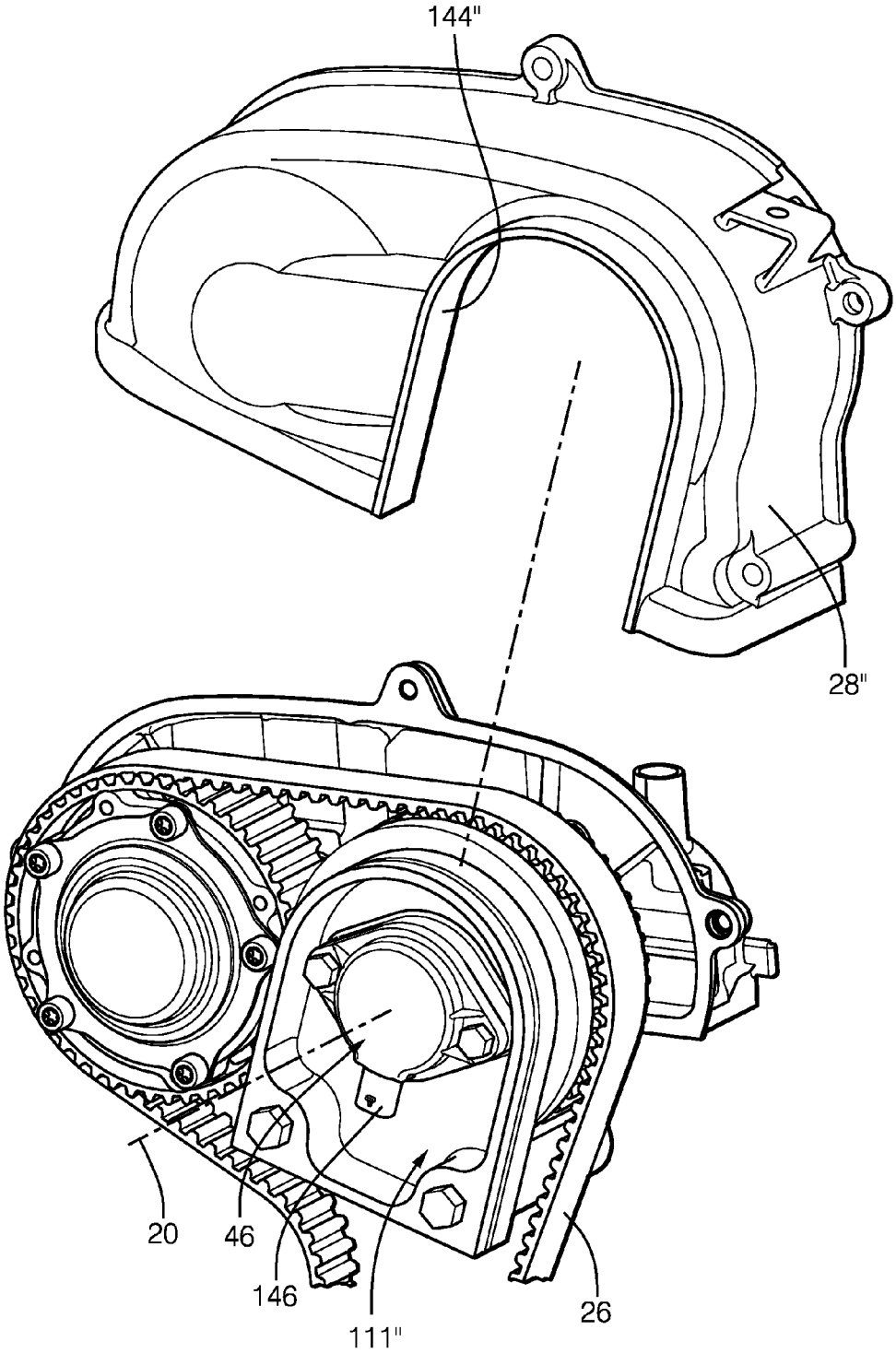
FIG. 10 is the isometric view of FIG. 9 now shown with the engine cover separated.

In another alternative arrangement as shown in FIGS. 9 and 10, an engine cover 28" is provided. Engine cover 28" differs from engine cover 28 and engine cover 28' in that engine cover 28" interfaces with an actuator mount 111" rather than with actuator 46. Engine cover 28" includes an engine cover aperture 144" which is discontinuous and substantially "U" shaped, i.e. engine cover aperture 144" is not defined by engine cover 28" in a 360° relationship. Actuator mount 111" is shaped to be complementary to engine cover aperture 144" such that the interface between actuator mount 111" and engine cover aperture 144" is sealed, for example with an O-ring, gasket, or sealant, thereby preventing foreign material from entering dry zone 110 from the environment. Since engine cover aperture 144" is discontinuous, removal of engine cover 28" may be accomplished by displacing engine cover 28" in a direction either parallel or perpendicular to camshaft axis 20 or at any angle therebetween. The arrangement of engine cover 28" and actuator mount 111" also allows for service of actuator 46 without removal of engine cover 28".

While actuator to camshaft phaser seal 112 has been illustrated as being fixed to actuator mount 111, it should now be understood that actuator to camshaft phaser seal 112 may alternatively be attached to actuator 46. It should also now be understood that actuator mount 111 may be integrally formed with actuator 46. These alternatives similarly apply to and actuator mount 111".

As described above, actuator 46 is used to position valve spool 42 in order to change the rotational position of rotor 32 within stator 30. However, in an alternative arrangement, actuator 46 may be used to position valve spool 42 in order to affect a lock pin which selectively prevents and allows rotor 32 to rotate relative to stator 30. In a further alternative arrangement, actuator 46 may be used to position valve spool 42 to change the rotational position of rotor 32 within stator 30 and to affect the lock pin. In this way actuator 46 is generally said to operate camshaft phaser 22.

While the invention as described above has been describe in relation to camshaft phaser 22 which uses hydraulics to change the phase relationship of camshaft 16 relative to crankshaft 12, the invention is also envisioned to apply to camshaft phasers which use an electric motor to change the phase relationship of camshaft 16 relative to crankshaft 12. In the paragraphs that follow, such an arrangement will be described.

Figure 11:
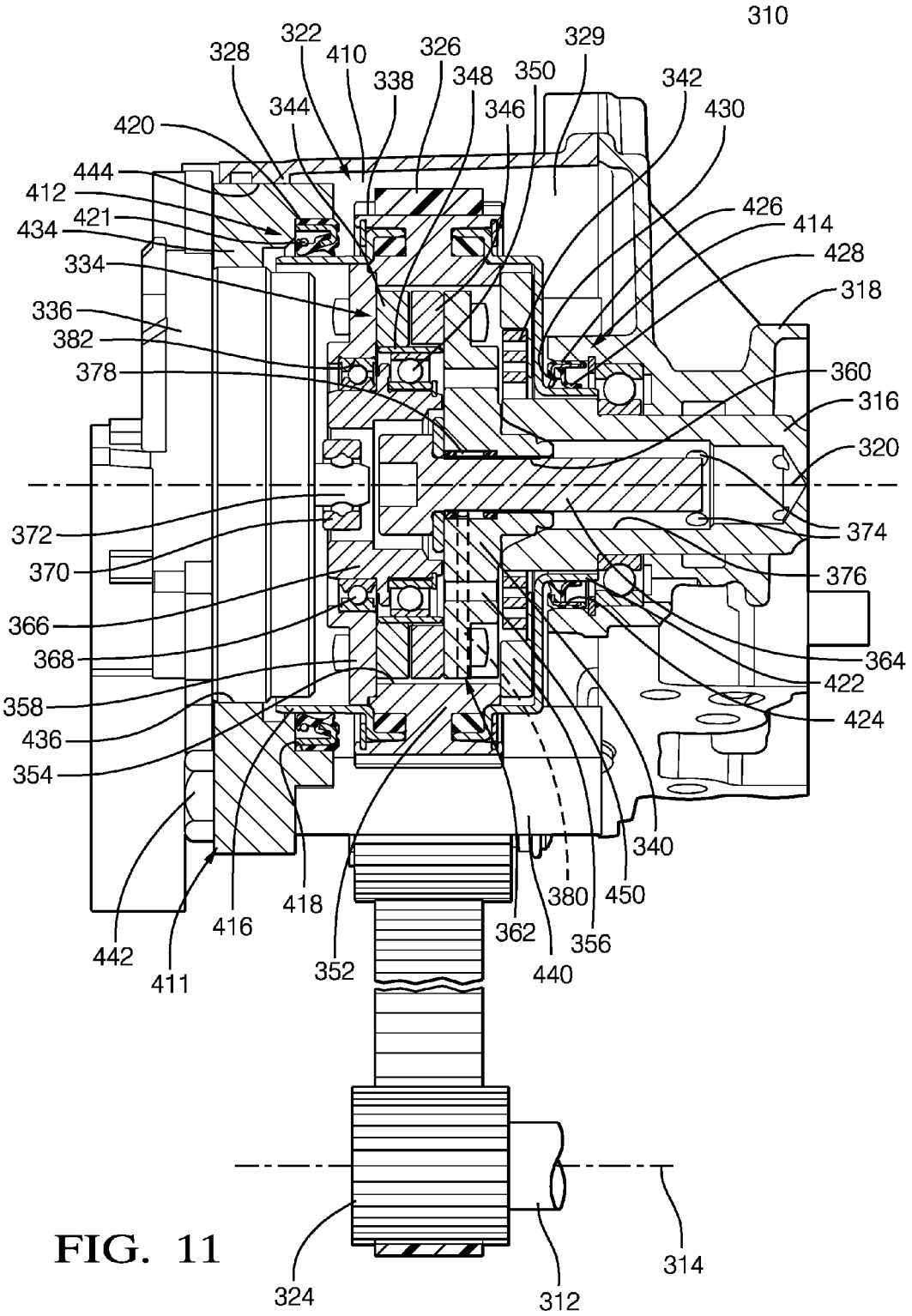
FIG. 11 an axial cross-sectional view of an alternative internal combustion engine in accordance with the present invention.
Figure 12:
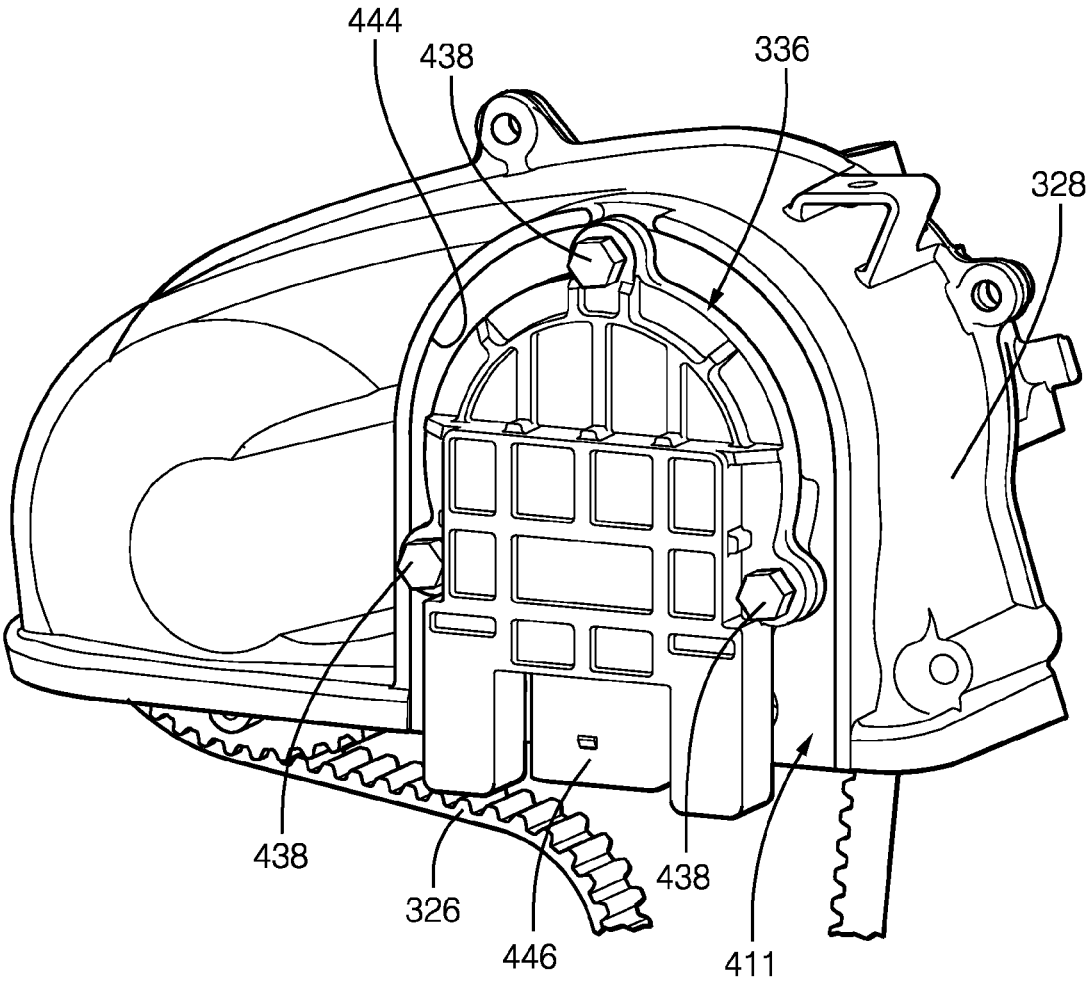
FIG. 12 is an isometric view of the internal combustion engine of FIG. 11 with an engine cover installed.
Figure 13:
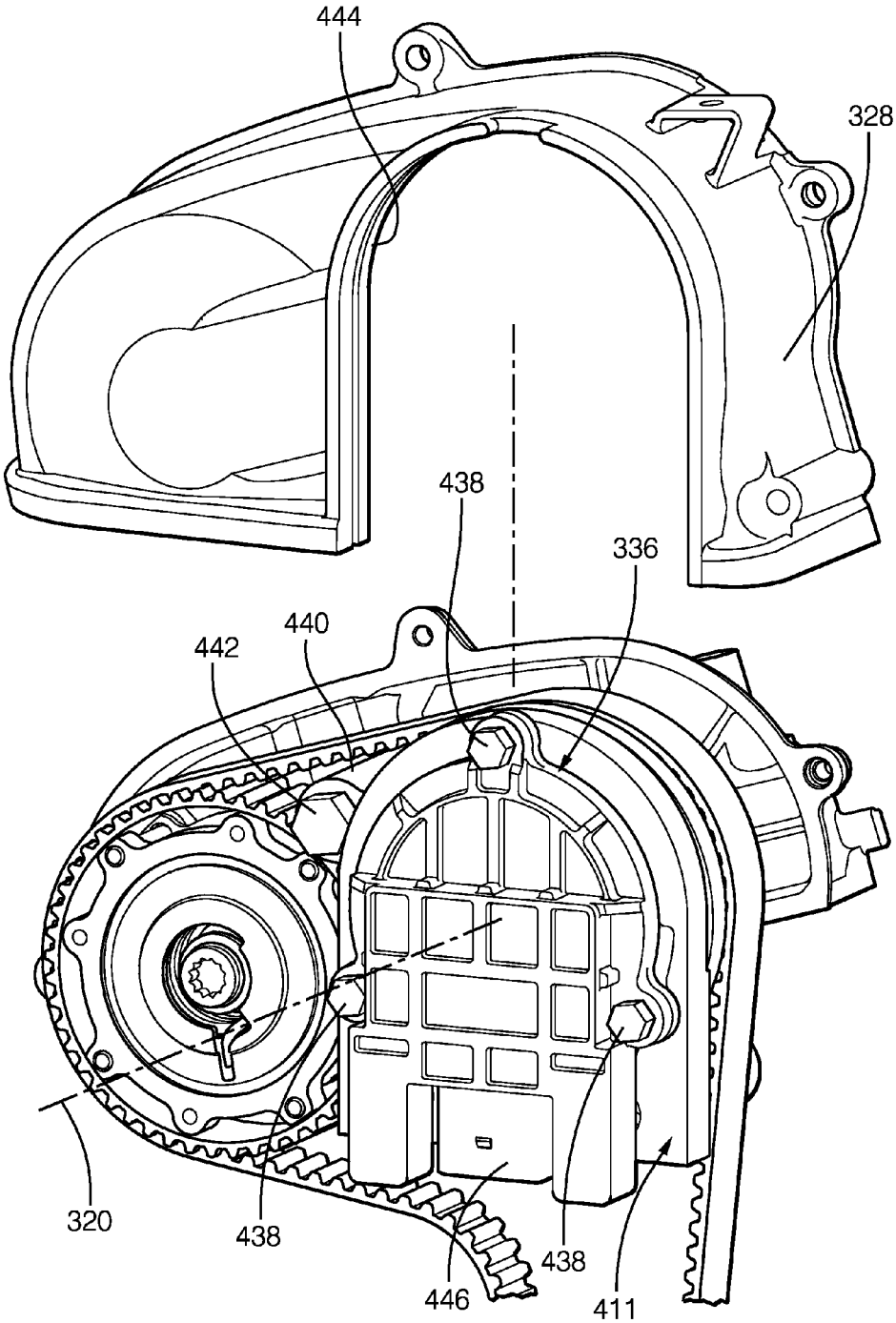
FIG. 13 is the isometric view of FIG. 12 now shown with the engine cover separated.

Referring now to FIGS. 11-13, an internal combustion engine 310 is shown in accordance with the present invention. Internal combustion engine 310 generally includes one or more pistons (not shown), a crankshaft 312 which rotates about a crankshaft axis 314, a camshaft 316 which is supported in a camshaft support 318 and rotates about a camshaft axis 320, and a camshaft phaser 322 which rotates about camshaft axis 320. Internal combustion engine 310 may be, for example only, spark ignited or compression ignited and may be fueled by any liquid fuel or gaseous fuel customarily used, for example only, liquid fuels such as gasoline, diesel fuel, alcohol, ethanol, and the like, and blends thereof or gaseous fuel such as natural gas, propane, and the like. The pistons, which are connected to crankshaft 312, reciprocate as a result of combustion of the fuel within respective combustion chambers (not shown). Reciprocation of the pistons causes crankshaft 312 to rotate about crankshaft axis 314. Crankshaft 312 includes a crankshaft pulley 324 which rotates a drive member 326, for example, a drive belt. Camshaft phaser 322 is rotated by drive member 326 and connected to camshaft 316; consequently, camshaft 316 rotates about camshaft axis 320 as a result of crankshaft 312. Rotation of camshaft 316 about camshaft axis 320 causes one or more combustion valves (not shown) to open and close. The combustion valves may allow a charge of air and/or fuel into the combustion chambers and/or exhaust constituents out of the combustion chambers. Camshaft phaser 322 allows the phase of rotation of camshaft 316 relative to crankshaft 312 to be varied, thereby varying the timing of opening and/or closing of the combustion valves relative to crankshaft 312 as will be described in greater detail later. An engine cover 328 encloses drive member 326 and camshaft phaser 322 in an engine cover volume 329 defined in internal combustion engine 310 by engine cover 328.

Camshaft phaser 322 comprises a gear drive unit illustrated as a harmonic gear drive unit 334; a rotational actuator 336 operationally connected to harmonic gear drive unit 334; an input pulley 338 operationally connected to harmonic gear drive unit 334 and driven by drive member 326 via crankshaft 312; an output hub 340 attached to harmonic gear drive unit 334 and mounted to an end of camshaft 316; and a bias spring 342 operationally disposed between output hub 340 and input pulley 338. Rotational actuator 336, hereinafter referred to as actuator 336, may be, for example only, a DC electric motor.

Harmonic gear drive unit 334 comprises an outer first spline 344 which may be either a circular spline or a dynamic spline as described below; an outer second spline 346 which is the opposite (dynamic or circular) of outer first spline 344 and is coaxially positioned adjacent outer first spline 344; a flexspline 348 disposed radially inwards of both outer first spline 344 and outer second spline 346 and having outwardly-extending gear teeth disposed for engaging inwardly-extending gear teeth on both outer first spline 344 and outer second spline 346; and a wave generator 350 disposed radially inwards of and engaging flexspline 348.

Flexspline 348 is a non-rigid ring with external teeth on a slightly smaller pitch diameter than the circular spline. Flexspline 348 is fitted over and elastically deflected by wave generator 350.

The circular spline is a rigid ring with internal teeth engaging the teeth of flexspline 348 across the major axis of wave generator 350.

The dynamic spline is a rigid ring having internal teeth of the same number as flexspline 348. The dynamic spline rotates together with flexspline 348 and serves as the output member. Either the dynamic spline or the circular spline may be identified by a chamfered corner at its outside diameter to distinguish one spline from the other. As shown, the chamfered corner has been used to identify outer second spline 346.

As is disclosed in the prior art, wave generator 350 is an assembly of an elliptical steel disc supporting an elliptical bearing, the combination defining a wave generator plug. A flexible bearing retainer surrounds the elliptical bearing and engages flexspline 348. Rotation of the wave generator plug causes a rotational wave to be generated in flexspline 348 (actually two waves 180° apart, corresponding to opposite ends of the major ellipse axis of the disc).

During assembly of harmonic gear drive unit 334, flexspline teeth engage both circular spline teeth and dynamic spline teeth along and near the major elliptical axis of the wave generator. The dynamic spline has the same number of teeth as the flexspline, so rotation of the wave generator causes no net rotation per revolution therebetween. However, the circular spline has slightly fewer gear teeth than does the dynamic spline, and therefore the circular spline rotates past the dynamic spline during rotation of the wave generator plug, defining a gear ratio therebetween (for example, a gear ratio of 50:1 would mean that 1 rotation of the circular spline past the dynamic spline corresponds to 50 rotations of the wave generator). Harmonic gear drive unit 334 is thus a high-ratio gear transmission; that is, the angular phase relationship between outer first spline 344 and outer second spline 346 changes by 2% for every revolution of wave generator 350.

Of course, as will be obvious to those skilled in the art, the circular spline may instead have slightly more teeth than the dynamic spline has, in which case the rotational relationships described below are reversed.

Input pulley 338 is rotationally fixed to a housing 352 which acts as an input member and which includes a housing bore 354 which extends coaxially therethrough within which output hub 340 and harmonic gear drive unit 334 are coaxially located. A back cover 356 is attached to an axial end of housing 352 that is proximal to camshaft 316 while a front cover 358 is fixed to the axial end of housing 352 that is opposite back cover 356. Back cover 356 and front cover 358 will be described in greater detail later.

Output hub 340, which acts as an output member for camshaft phaser 322, includes a central through bore 360 extending coaxially therethrough. Output hub 340 is disposed coaxially within housing 352 and mates with housing bore 354, thereby defining a journal bearing interface 362 between output hub 340 and housing 352 which substantially prevents tipping and radial movement of output hub 340 within housing 352 while allowing output hub 340 to rotate within housing 352. Output hub 340 is attached to camshaft 316 by a camshaft phaser attachment bolt 364 which extends through central through bore 360 and threadably engages camshaft 316. In this way, output hub 340 is clamped securely to camshaft 316 and relative rotation between output hub 340 and camshaft 316 is prevented.

A coupling adaptor 366 is mounted to wave generator 350 and extends through front cover 358 being supported by a bearing 368 mounted in front cover 358. A coupling 370 is mounted to a motor shaft 372 of actuator 336 and fixed thereto in order to prevent relative rotation between coupling 370 and motor shaft 372. Coupling 370 engages coupling adaptor 366, permitting wave generator 350 to be rotationally driven by actuator 336, as may be desired to alter the phase relationship between outer first spline 344 and outer second spline 346. In this way, actuator 336 is generally said to operate camshaft phaser 322. Further features of coupling adaptor 366 and coupling 370 are disclosed in United States Patent Application Publication No. US 2012/0291729 A1 to David et al., the disclosure of which is incorporated herein by reference in its entirety.

In order to ensure smooth operation and provide resistance to wear, journal bearing interface 362 may be supplied with oil, for example, from internal combustion engine 310. Oil under pressure may be supplied via an oil gallery (not shown) of internal combustion engine 310 through camshaft radial oil passages 374 of camshaft 316 to a camshaft counter bore 376 which extends axially into camshaft 316. From camshaft counter bore 376, the oil is communicated to an annular space formed radially between camshaft phaser attachment bolt 364 and central through bore 360 of output hub 340 where the oil is passed through a filter 378 located within central through bore 360 of output hub 340 and is communicated to journal bearing interface 362 through one or more output hub oil passages 380 that extend radially outward through output hub 340 to journal bearing interface 362 from central through bore 360 of output hub 340. Oil that passes by journal bearing interface 362 in the axial direction away from back cover 356 is allowed to lubricate harmonic gear drive unit 334, bearing 368, and coupling 370 through gravity and dynamics of camshaft phaser 322 in use. It should now be understood that additional oil passages may be provided, for example as disclosed in United States Patent Application Publication No. US 2012/0312258 A1 to Kimus et al., the disclosure of which is incorporated herein by reference in its entirety.

Outer second spline 346 is secured coaxially to output hub 340, for example with bolts, thereby securely clamping outer second spline 346 to output hub 340 and thereby preventing relative rotation between outer second spline 346 and output hub 340. In this way, output hub 340 rotates with outer second spline 346 in a one-to-one relationship.

Front cover 358 includes a front cover bore 382 extending axially therethrough. Outer first spline 344 is secured to front cover 358, for example by bolts, thereby preventing relative rotation between outer first spline 344 and front cover 358. Front cover bore 382 receives bearing 368 coaxially therewithin such that bearing 368 is fixed within front cover bore 382, for example, by press fit. Front cover 358 is secured to housing 352, for example by bolts, thereby preventing relative rotation between front cover 358 and housing 352. In this way relative rotation between input pulley 338, housing 352, front cover 358, and outer first spline 344 is prevented.

Bias spring 342 is captured axially between output hub 340 and back cover 356. An inner spring tang (not shown) of bias spring 342 is engaged with output hub 340 while an outer spring tang (not shown) of bias spring 342 is engaged with back cover 356. In the event of a malfunction of actuator 336, bias spring 342 is biased to back-drive harmonic gear drive unit 334 without help from actuator 336 to a predetermined rotational position of outer second spline 346. The predetermined position may be a position which allows internal combustion engine 310 to start or run, and the predetermined position may be at one of the extreme ends of the range of authority or intermediate of the phaser's extreme ends of its rotational range of authority. For example, the rotational range of travel in which bias spring 342 biases harmonic gear drive unit 334 may be limited to something short of the end stop position of the phaser's range of authority. Such an arrangement would be useful for internal combustion engines requiring an intermediate park position for idle or restart.

Drive member 326 may not be compatible with the oil used to lubricate camshaft phaser 322; consequently, a dry zone 410 may be formed within engine cover 328. Drive member 326 is located within dry zone 410 which is substantially free of the oil used to lubricate camshaft phaser 322. Actuator 336 is mounted to internal combustion engine 310 via an actuator mount 411 which is at least partially within dry zone 410 as actuator mount 411 will be described in greater detail later. Dry zone 410 is formed by a sealing arrangement which may comprise an actuator to camshaft phaser seal 412 and an engine to camshaft phaser seal 414. The sealing arrangement will be described in greater detail in the paragraphs that follow.

Actuator to camshaft phaser seal 412 provides a seal between actuator mount 411 and a front housing sealing body 416 which is sealingly fixed to housing 352. Actuator mount 411 may define an actuator to camshaft phaser seal bore 418 which is substantially cylindrical in shape, centered about camshaft axis 320, and extends axially into actuator mount 411. Actuator to camshaft phaser seal 412 includes an actuator to camshaft phaser seal supporting body 420 which is ring shaped and secured coaxially within actuator to camshaft phaser seal bore 418, for example, by a press fit. Actuator to camshaft phaser seal supporting body 420 may be made of a rigid material, for example, metal or plastic. Actuator to camshaft phaser seal 412 also includes an actuator to camshaft phaser seal lip seal 421 which extends radially inward from actuator to camshaft phaser seal supporting body 420. Actuator to camshaft phaser seal lip seal 421 may be molded and bonded to actuator to camshaft phaser seal supporting body 420 and may be made of an elastomeric or rubber-like material, for example only, Nitrile Butadiene Rubber (NBR), Viton®, or silicone. Front housing sealing body 416 radially mates with actuator to camshaft phaser seal lip seal 421. A portion of front housing sealing body 416 is ring-shaped and extends axially toward actuator 336 and into actuator to camshaft phaser seal bore 418 in a coaxial relationship therewith. Front housing sealing body 416 is sized to elastically deform actuator to camshaft phaser seal lip seal 421 when assembled in order to provide an oil-tight seal between front housing sealing body 416 and actuator to camshaft phaser seal lip seal 421. Actuator to camshaft phaser seal lip seal 421 is sized to provide sufficient compliance to accommodate mismatch in concentricity between actuator to camshaft phaser seal 412 and front housing sealing body 416 due to manufacturing tolerances. In this way, oil that exits the end of housing 352 which is proximal to actuator 336 is prevented from entering dry zone 410 as camshaft phaser 322 rotates with respect to actuator to camshaft phaser seal 412 in operation. In addition to actuator to camshaft phaser seal lip seal 421, actuator to camshaft phaser seal 412 may include a dust seal lip which protects actuator to camshaft phaser seal lip seal 421 from external contamination that may have undesirable effects on actuator to camshaft phaser seal lip seal 421.

Engine to camshaft phaser seal 414 provides a seal between camshaft support 318 and a back housing sealing body 422 that is sealingly fixed to the side of housing 352 that is opposite of front housing sealing body 416. A camshaft support bore 424, which is cylindrical, extends into camshaft support 318 in a coaxial relationship with camshaft 316. Engine to camshaft phaser seal 414 includes an engine to camshaft phaser seal supporting body 426 which is ring shaped and secured coaxially within camshaft support bore 424, for example, by a press fit. Engine to camshaft phaser seal supporting body 426 may be made of a rigid material, for example, metal or plastic. Engine to camshaft phaser seal 414 also includes an engine to camshaft phaser seal lip seal 428 which extends radially inward from engine to camshaft phaser seal supporting body 426. Engine to camshaft phaser seal lip seal 428 may be molded and bonded to engine to camshaft phaser seal supporting body 426 and may be made of an elastomeric or rubber-like material, for example only, Nitrile Butadiene Rubber (NBR), Viton®, or silicone. Engine to camshaft phaser seal 414 may also include an engine to camshaft phaser seal dust lip seal 430 which extends radially inward from engine to camshaft phaser seal supporting body 426 and may be made from the same material as engine to camshaft phaser seal lip seal 428. Engine to camshaft phaser seal dust lip seal 430 protects engine to camshaft phaser seal lip seal 428 from external contamination that may have undesirable effects on engine to camshaft phaser seal lip seal 428. A portion of back housing sealing body 422 is ring-shaped and extends axially into camshaft support bore 424 in a coaxial relationship. Back housing sealing body 422 is sized to elastically deform engine to camshaft phaser seal lip seal 428 when assembled in order to provide an oil-tight seal between back housing sealing body 422 and engine to camshaft phaser seal lip seal 428.

Actuator mount 411 includes an actuator mount body 434 with an actuator mount aperture 436 extending axially therethrough such that actuator mount aperture 436 allows a portion of actuator 336 to extend therethrough. Camshaft phaser seal bore 418, which was described above, is defined by actuator mount body 434. Actuator 336 is fixed to actuator mount 411, for example, with actuator bolts 438 which threadably engage actuator mount 411. Actuator 336 is sealed to actuator mount 411, for example by an O-ring, gasket, or sealant (not show), thereby preventing oil from reaching dry zone 410 and/or the external environment through actuator mount aperture 436. Actuator mount 411 includes actuator mount mounting bosses 440 to receive actuator mount bolts 442 which threadably engage internal combustion engine 310, thereby clamping actuator mount 411 to internal combustion engine 10.

Engine cover 328 includes an engine cover aperture 444 extending therethrough which allows an electrical connector 446 of actuator 336 to be accessible outside of engine cover volume 329 and dry zone 410, thereby allowing a mating connector (not shown) to be attached to electrical connector 446 in order to control actuator 336. As shown, engine cover aperture 444 may be discontinuous and substantially "U" shaped, i.e. engine cover aperture 444 is not defined by engine cover 328 in a 360° relationship. Actuator mount 411 is shaped to be complementary to engine cover aperture 444 such that the interface between actuator mount 411 and engine cover aperture 444 is sealed, for example with an O-ring, gasket, or sealant, thereby preventing foreign material from entering dry zone 410 from the environment. Since engine cover aperture 444 is discontinuous, removal of engine cover 328 may be accomplished by displacing engine cover 328 in a direction either parallel or perpendicular to camshaft axis 20 or any angle therebetween. Alternatively, engine cover aperture 444 may be similar to engine cover aperture 144 described above which is continuous, i.e. engine cover aperture 444 may be defined by engine cover 328 in a 360° relationship. When this alternative approach is taken, actuator 336 or actuator mount 411 may be sealed to engine cover aperture 444.

A drain passage 450 is provided axially through output hub 340 in order to return oil to internal combustion engine 310. The oil exits drain passage 450 that is proximal to camshaft 316 and is prevented from entering dry zone 410 by engine to camshaft phaser seal 414 and is subsequently returned to internal combustion engine 310.

Since actuator 336 is mounted to internal combustion engine 310 structurally independent of engine cover 328, engine cover 328 can be removed from internal combustion engine 310 in order to service drive member 326 without the need to remove actuator 336 from internal combustion engine 310. Since actuator 336 does not need to be removed, there is no risk of contaminating dry zone 410 with oil from camshaft phaser 322 when servicing drive member 326. The arrangement of engine cover 328 and actuator mount 311 also allows for service of actuator 336 without removal of engine cover 328. It should be noted that actuator mount 411 is within the path of drive member 326; consequently, drive member 326 can be removed while actuator 336 and actuator mount 411 are attached to internal combustion engine 310.

While actuator to camshaft phaser seal 412 has been illustrated as being fixed to actuator mount 411, it should now be understood that actuator to camshaft phaser seal 412 may alternatively be attached to actuator 336. It should also now be understood that actuator mount 411, may be integrally formed with actuator 336.

The embodiment described herein describes harmonic gear drive unit 334 as comprising outer first spline 344 which may be either a circular spline or a dynamic spline which serves as the input member; an outer second spline 346 which is the opposite (dynamic or circular) of outer first spline 344 and which serves as the output member and is coaxially positioned adjacent outer first spline 344; a flexspline 348 disposed radially inwards of both outer first spline 344 and outer second spline 346 and having outwardly-extending gear teeth disposed for engaging inwardly-extending gear teeth on both outer first spline 344 and outer second spline 346; and a wave generator 350 disposed radially inwards of and engaging flexspline 348. As described, harmonic gear drive unit 334 is a flat plate or pancake type harmonic gear drive unit as referred to in the art. However, it should now be understood that other types of harmonic gear drive units may be used in accordance with the present invention. For example, a cup type harmonic gear drive unit may be used. The cup type harmonic gear drive unit comprises a circular spline which serves as the input member; a flexspline which serves as the output member and which is disposed radially inwards of the circular spline and having outwardly-extending gear teeth disposed for engaging inwardly-extending gear teeth on the circular spline; and a wave generator disposed radially inwards of and engaging the flexspline.

While the gear drive unit of camshaft phaser 22 has been described herein as harmonic gear drive unit 334, it should now be understood that the invention encompasses camshaft phasers using any known gear drive units. Other gear drive units that may be used within the scope of this invention include, by non-limiting example, spur gear units, helical gear units, worm gear units, hypoid gear units, planetary gear units, and bevel gear units.

While this invention has been described in terms of preferred embodiments thereof, it is not intended to be so limited, but rather only to the extent set forth in the claims that follow.

We claim:

1. An internal combustion engine having a crankshaft rotatable about a crankshaft axis and a camshaft rotatable by said crankshaft about a camshaft axis, said internal combustion engine comprising:

an engine cover defining an engine cover volume within said internal combustion engine;

a drive member disposed within said engine cover volume which transfers rotational motion from said crankshaft to said camshaft;

a camshaft phaser disposed within said engine cover volume which controllably varies the phase relationship between said crankshaft and said camshaft;

an actuator which operates said camshaft phaser; and an actuator mount within said engine cover volume which mounts said actuator structurally independent of said engine cover, thereby allowing removal of said engine cover independently of said actuator;

wherein said actuator is located partially within said engine cover volume; and wherein said engine cover includes an engine cover aperture extending through a wall of said engine cover such that said actuator extends through said engine cover aperture outside of said engine cover volume.

2. An internal combustion engine as in claim 1 wherein said engine cover aperture extends through said engine cover in a direction parallel to said camshaft axis.

3. An internal combustion engine as in claim 1 wherein said engine cover aperture extends through said engine cover in a direction perpendicular to said camshaft axis.

4. An internal combustion engine as in claim 1 wherein said engine cover aperture is discontinuous.

5. An internal combustion engine as in claim 4 wherein said engine cover aperture is "U" shaped.

6. An internal combustion engine as in claim 4 wherein said actuator mount is shaped complementary to said engine cover aperture such that an interface between said actuator mount and said engine cover aperture is sealed.

7. An internal combustion engine as in claim 1 wherein said actuator includes an electrical connector which extends through said engine cover aperture.

8. An internal combustion engine as in claim 1 wherein said actuator mount is sealed to said engine cover aperture, thereby preventing foreign matter from entering said engine cover volume through said engine cover aperture.

9. An internal combustion engine as in claim 1 wherein said actuator mount includes a plurality of actuator mount mounting bosses which each receive a respective actuator mount bolt which threadably engages said internal combustion engine, thereby clamping said actuator mount to said internal combustion engine through said plurality of actuator mount mounting bosses.

10. An internal combustion engine as in claim 9 wherein each of said plurality of actuator mount mounting bosses are surrounded by said drive member.

11. An internal combustion engine as in claim 9 wherein said drive member has an inner periphery and each of said plurality of actuator mount mounting bosses are within said inner periphery of said drive member.

12. An internal combustion engine as in claim 1 further comprising an actuator to camshaft phaser seal which seals between said actuator mount and said camshaft phaser.

13. An internal combustion engine as in claim 12 wherein said actuator to camshaft phaser seal is secured to said actuator mount.

14. An internal combustion engine as in claim 13 wherein said actuator mount includes an actuator mount seal support which is ring-shaped such that said actuator to camshaft phaser seal is secured to said actuator mount seal support.

15. An internal combustion engine as in claim 13 wherein said actuator mount includes an actuator mount seal support which is ring-shaped such that said actuator to camshaft phaser seal is secured coaxially within said actuator mount seal support.

16. An internal combustion engine as in claim 1 wherein said actuator is a solenoid actuator.

17. An internal combustion engine as in claim 1 wherein said actuator is an electric motor.

* * * * *